US009121404B2

(12) United States Patent
Kitano

(10) Patent No.: US 9,121,404 B2
(45) Date of Patent: Sep. 1, 2015

(54) SCREW COMPRESSOR UNIT

(71) Applicant: Kobe Steel, Ltd., Kobe-shi (JP)

(72) Inventor: Toshiki Kitano, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/869,264

(22) Filed: Apr. 24, 2013

(65) Prior Publication Data

US 2013/0315766 A1 Nov. 28, 2013

(30) Foreign Application Priority Data

May 22, 2012 (JP) ..... 2012-116650

(51) Int. Cl.

| | |
|---|---|
| ***F04B 35/00*** | (2006.01) |
| ***F04C 2/08*** | (2006.01) |
| ***F04C 29/00*** | (2006.01) |
| ***F04C 18/16*** | (2006.01) |

(52) U.S. Cl.
CPC . *F04C 2/08* (2013.01); *F04C 18/16* (2013.01); *F04C 29/0021* (2013.01)

(58) Field of Classification Search
CPC ..... F04C 2/08; F04C 18/06; F04C 28/12; F04C 28/125; F04C 29/0211
USPC ..... 417/365
See application file for complete search history.

(56) References Cited

U.S. PATENT DOCUMENTS

| | | | | |
|---|---|---|---|---|
| 3,708,959 | A * | 1/1973 | Soumerai et al. | 95/268 |
| 3,796,526 | A | 3/1974 | Cawley | |
| 5,135,374 | A * | 8/1992 | Yoshimura et al. | 418/201.2 |
| 5,509,273 | A * | 4/1996 | Lakowske et al. | 62/228.5 |
| 7,063,512 | B2 * | 6/2006 | Haesloop et al. | 417/244 |
| 7,347,301 | B2 | 3/2008 | Sekiya et al. | |
| 2007/0163840 | A1 * | 7/2007 | Sekiya et al. | 184/6.16 |
| 2010/0329916 | A1 * | 12/2010 | Yoshimura | 418/88 |

FOREIGN PATENT DOCUMENTS

| | | |
|---|---|---|
| EP | 1 780 416 A1 | 5/2007 |
| JP | 2002-168185 | 6/2002 |
| JP | 2002-317782 A | 10/2002 |
| JP | 4050657 | 12/2007 |
| SU | 1652658 A1 | 5/1991 |

* cited by examiner

*Primary Examiner* — Charles Freay
(74) *Attorney, Agent, or Firm* — Oblon, McClelland, Maier & Neustadt, L.L.P.

(57) ABSTRACT

In a capacity-adjustable screw compressor unit, a thrust force caused by a reaction force of gas can be appropriately cancelled by a balance piston. A screw compressor unit of the present invention includes a compressor, having a pair of male and female screw rotors meshing with each other contained in a casing, for compressing sucked gas and discharging it, a balance piston for pressing a rotor shaft acting as a rotating shaft of at least one of the screw rotors in an axial direction by a fluid pressure, a slide valve for adjusting capacity of the compressor, and a balance piston control device for adjusting pressure of a fluid applied on the balance piston according to the capacity of the compressor calculated from a position of the slide valve.

6 Claims, 4 Drawing Sheets

SCREW COMPRESSOR UNIT

BACKGROUND OF THE INVENTION

1. Field of the Invention

The present invention relates to a screw compressor unit.

2. Description of the Related Art

In a screw compressor, a reaction force of compressed gas acts on a suction side in an axial direction against a screw rotor. Therefore, the screw compressor is provided with a thrust bearing for receiving a thrust load of a rotor shaft. When a discharge pressure of the screw compressor increases, a thrust force caused by the reaction force of gas also increases, thus resulting in shortening the life of the thrust bearing.

Therefore, Japanese Patent Laid-Open No. 2002-168185 and Japanese Patent Registration No. 4050657 disclose a technique in which a balance piston connected to a rotor shaft is fitted in a cylinder, pressure of a fluid supplied to the cylinder is applied to the balance piston, and the rotor shaft is pressed to a discharge side in an axial direction.

While Japanese Patent Laid-Open No. 2002-168185 discloses an invention in which the balance piston is pressed by pressure of gas discharged by a screw compressor, a difference between a thrust force caused by a reaction force of gas and a thrust force generated by the balance piston is generated by a variation of a suction pressure of the screw compressor.

Japanese Patent Registration No. 4050657 discloses an invention in which the balance piston is pressed by pressure oil supplied from a hydraulic pump. There, a control valve whose opening is adjusted according to suction/discharge pressures of the screw compressor is provided in an oil supply passage to adjust pressure of the pressure oil applied on the balance piston, thereby adjusting the magnitude of the thrust force generated by the balance piston.

However, a change in the thrust force caused by the reaction force of gas does not depend only on the suction/discharge pressures. For example, in a screw compressor whose capacity is adjusted by changing an opening position of a rotor chamber by means of a slide valve, the magnitude of the thrust force caused by the reaction force of gas is changed according to a position of the slide valve even if the suction pressure and the discharge pressure are the same.

In consideration to the above problems, the present invention is to provide a capacity-adjustable screw compressor capable of appropriately cancelling a thrust force generated by a balance piston and a thrust force caused by a reaction force of gas each other.

SUMMARY OF THE INVENTION

In order to achieve the above object, a screw compressor unit according to the present invention includes a casing, a pair of male and female screw rotors contained in the casing and meshing with each other, a compressor having the casing and the screw rotors and for compressing sucked gas and discharging it, a balance piston for pressing a rotor shaft acting as a rotating shaft of at least one of the screw rotors in an axial direction by a fluid pressure, a capacity adjuster for adjusting capacity of the compressor, and a balance piston control device for adjusting pressure of a fluid applied on the balance piston according to the capacity of the compressor.

Where, the capacity of the compressor specifically means an amount of gas to be compressed in the compressor (a compressed air quantity).

According to the above configuration, even if a thrust force applied on the screw rotors by a reaction force of gas changes by adjusting the capacity of the compressor, the pressure of the fluid that presses the balance piston is changed according to the capacity of the compressor. Therefore, a thrust force generated by the balance piston and the thrust force caused by the reaction force of gas can be appropriately cancelled each other.

In the screw compressor unit of the present invention configured as described above, the capacity adjuster may include a slide valve, and the balance piston control device may adjust the pressure of the fluid applied on the balance piston according to a position of the slide valve.

In addition, the screw compressor unit of the present invention may include a suction pressure detector for detecting pressure of gas sucked by the compressor, and the balance piston control device may adjust the pressure of the fluid applied on the balance piston by taking account of a detected value of the suction pressure detector. Further, the screw compressor unit of the present invention may include a discharge pressure detector for detecting pressure of gas discharged by the compressor, and the balance piston control device may adjust the pressure of the fluid applied on the balance piston by adding a detected value of the discharge pressure detector.

According to the above configuration, the thrust force generated by the balance piston can be adjusted according to a change in the thrust force caused by the reaction force of gas applied on the screw rotors due to changes in suction/discharge pressures.

Thus, according to the present invention, since the balance piston control device adjusts the pressure of the fluid applied on the balance piston according to the capacity of the compressor, even if the thrust force caused by the reaction force of gas changes according to the capacity of the compressor, the thrust force generated by the balance piston and the thrust force caused by the reaction force of gas can be appropriately cancelled each other.

DESCRIPTION OF THE PREFERRED EMBODIMENTS

Figure 1:
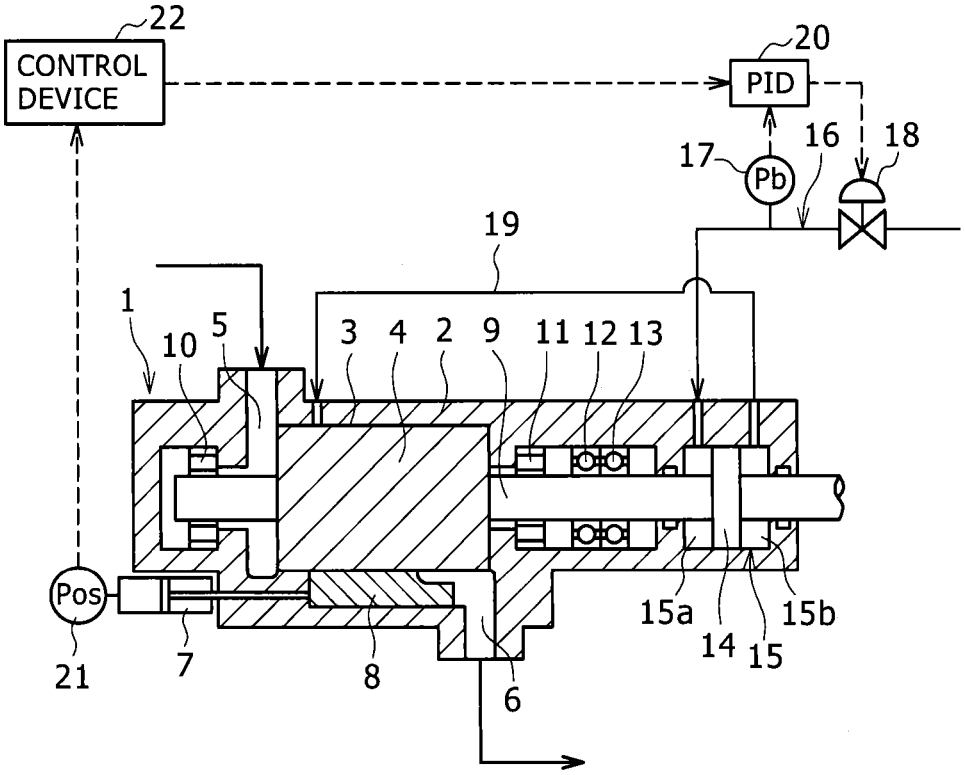
FIG. 1 is a schematic configuration diagram of a screw compressor unit according to a first embodiment of the present invention.

Hereinafter, embodiments of the present invention will be described with reference to the drawings. First, FIG. 1 shows a configuration of a screw compressor unit according to a first embodiment of the present invention in a simplified manner. The screw compressor unit of the present embodiment is comprised of a compressor 1 and accessory equipment described later.

The compressor 1 contains a pair of male and female screw rotors 4 in a rotor chamber 3 formed in a casing 2. The screw rotors 4 form a plurality of compression spaces by dividing a space within the rotor chamber 3 and change the size of the compression space along with their rotation. The compressor 1 sucks gas in the compression spaces through a suction passage 5 communicating with the rotor chamber 3 by the rotation of the screw rotors 4, compresses the sucked gas, and discharges the compressed gas through a discharge passage 6 communicating with the rotor chamber 3.

An opening position of the rotor chamber 3 with respect to the discharge passage 6 is determined according to a position of a slide valve (capacity adjuster) 8 driven by a fluid cylinder 7. Specifically, the volume of the compression space at the moment of communicating with the discharge passage 6 is changed according to the position of the slide valve 8. Here, if the volume of the compression space increases, a mechanical compression ratio of the compressor 1 increases, and if the volume of the compression space decreases, the mechanical compression ratio of the compressor 1 decreases. Hereinafter, the volume of the compression space is referred to as a capacity of the compressor.

A rotor shaft 9 acting as a rotating shaft of the screw rotors 4 is supported by radial bearings 10, 11 and thrust bearings 12, 13, and thus the screw rotors 4 are configured rotatably. In addition, in the casing 2, formed a cylindrical balance cylinder 15 in which a disk-shaped balance piston 14 integrally mounted to the shaft of one screw rotor 4 (usually, the male screw rotor) of the pair of male and female screw rotors 4 is fitted. The rotor shaft 9 extends through the balance cylinder 15 and is connected to a motor (not shown). To a space (a high-pressure chamber 15*a*) closer to the screw rotors 4 than the balance piston 14 within the balance cylinder 15, pressure oil is supplied through an oil supply passage 16. In the oil supply passage 16, an oil supply pressure detector 17 for detecting pressure Pb of pressure oil supplied to the balance cylinder 15 and an opening-adjustable control valve 18 located upstream of the oil supply pressure detector 17 are provided. Another space (a low-pressure chamber 15*b*) within the balance cylinder 15 opposite to a portion facing a high-pressure side of the balance piston 14 (that is, a space farther from the screw rotors 4 than the balance piston 14 within the balance cylinder 15, in the present embodiment) communicates with a low-pressure compression space close to the suction passage 5 within the rotor chamber 3 through a low-pressure communicating passage 19.

In addition, the compressor unit of the present embodiment includes a valve adjuster 20 for adjusting the opening of the control valve 18, by a known PID control, for example, such that a detected value of the oil supply pressure detector 17 may become a pressure setting value, a positioner 21 for detecting a position of a piston of the fluid cylinder 7 in order to specify the position of the slide valve 8, and a control device (balance piston control device) 22 for setting the pressure setting value of the valve adjuster 20 based on a detected value of the positioner 21.

The pressure oil supplied to the high-pressure chamber 15*a* of the balance cylinder 15 leaks to the low-pressure chamber 15*b* through a clearance between an outer circumference of the balance piston 14 and an inner wall of the balance cylinder 15, and is supplied to the rotor chamber 3 through the low-pressure communicating passage 19 and used also for lubricating the screw rotors 4, for example. The internal pressure of the high-pressure chamber 15*a* is maintained at the pressure substantially equal to the pressure setting value by the action of the control valve 18 adjusted by the valve adjuster 20. On the other hand, the internal pressure of the low-pressure chamber 15*b* becomes the pressure equal to the pressure of the low-pressure compression space within the rotor chamber 3 communicating with it through the low-pressure communicating passage 19. A difference between the internal pressure of the high-pressure chamber 15*a* and the internal pressure of the low-pressure chamber 15*b* is due to a loss pressure generated when oil passes through the clearance between the balance piston 14 and the balance cylinder 15.

In addition, the difference between the internal pressure of the high-pressure chamber 15*a* and the internal pressure of the low-pressure chamber 15*b* generates a force pressing the balance piston 14 in an axial direction of the rotor shaft 9 toward the low-pressure chamber 15*b* from the high-pressure chamber 15*a*. Thereby, the screw rotors 4 are pulled by the balance piston 14 and pressed to a discharge side in the axial direction. The control device 22 adjusts the pressure setting value (that is, the internal pressure of the high-pressure chamber 15*a*) such that the pressing force by the balance piston 14 is balanced with the reaction force of gas compressed by the screw rotors 4.

Where, assuming that the position of the slide valve 8 is L and the capacity (the ratio when the maximum capacity is assumed to be 100%) of the compressor 1 is X (%), the capacity X can be represented by $X=f(L)$ as a function of the position L of the slide valve 8. Further, assuming that the thrust force pressing the screw rotors 4 to the suction side by the reaction force of the compressed gas is Y(N), the thrust force Y can be represented by $Y=g(X)$ as a function of the capacity X. Accordingly, the thrust force Y can be calculated from the position L of the slide valve. It should be noted that the capacity of the compressor 1 and the load of the compressor 1 are correlated. For example, if the capacity of the compressor 1 and thus the compressed air quantity increases, the load of the compressor 1 also increases.

Therefore, the control device 22 resets successively the pressure setting value of the valve adjuster 20 so as to be balanced with the pressing force (a value that the differential pressure of the high-pressure chamber 15*a* and the low-pressure chamber 15*b* is multiplied by the area of the balance piston 14) of the pressure oil applied on the balance piston 14.

At this time, complete correspondence between the thrust force Y of the gas pressure and the pressing force of the balance piston 14 is not necessary, and a difference thereof is preferably within an allowable range of the thrust bearings 12, 13. Therefore, the position L of the slide valve 8 may be classified into a plurality of ranges, a lookup table in which the pressure setting values are assigned to the respective classifications one by one may be stored in the control device 22 in advance, and then the pressure setting value can be specified easily from the position of the slide valve 8.

Figure 2:
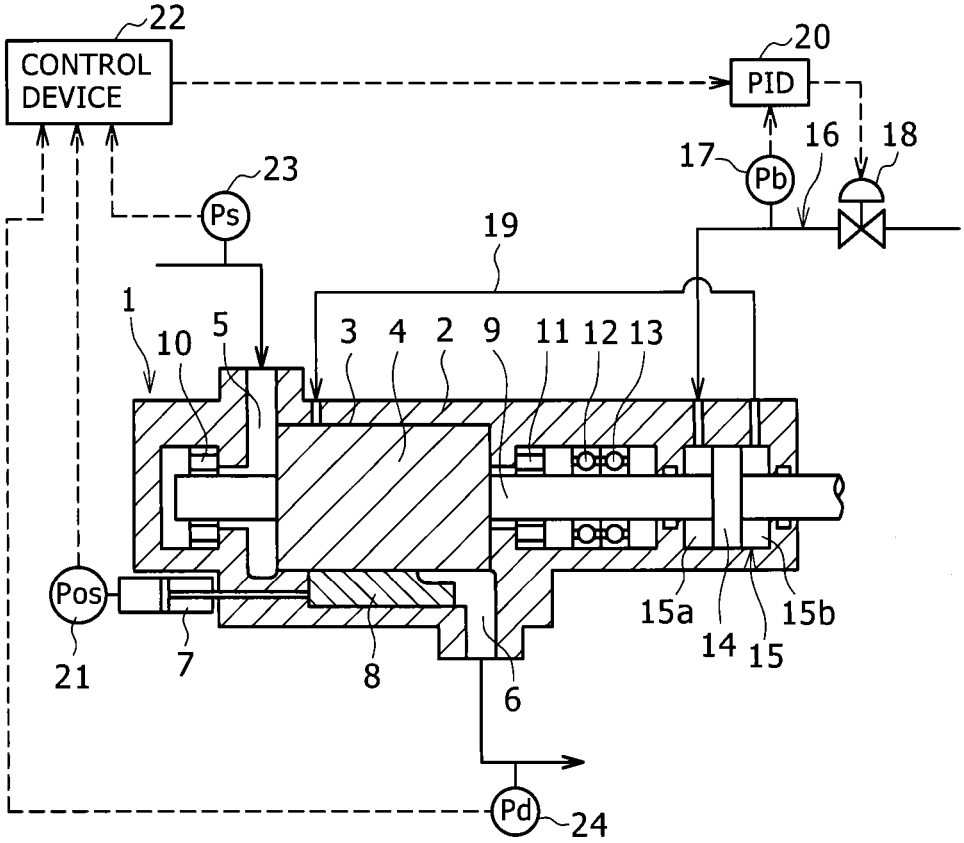
FIG. 2 is a schematic configuration diagram of a screw compressor unit according to a second embodiment of the present invention.

Next, FIG. 2 shows a configuration of a compressor unit according to a second embodiment of the present invention. It should be noted that, in the following description of the embodiments, same constituent elements as the constituent elements according to the embodiment explained earlier will be given the same reference numerals and an overlapping description thereof will be omitted. The compressor unit of the present embodiment includes a suction pressure detector 23 for detecting pressure Ps of gas sucked by the compressor 1 and a discharge pressure detector 24 for detecting pressure Pd of gas discharged by the compressor 1, and the control device 22 calculates the pressure setting value of the valve adjuster 20 by taking account of a detected value of the suction pressure detector 23 and a detected value of the discharge pressure detector 24 in addition to the position of the slide valve 8.

The capacity X of the compressor 1 (and thus the load of the compressor 1) varies depending also on the pressure of gas sucked by the compressor 1 and the pressure of gas discharged by the compressor 1. The capacity X can be represented by $X=f(L)\cdot h(Ps)\cdot l(Pd)$ by multiplying the function f(L) of the position L of the slide valve 8 and a function h(Ps) of the suction pressure Ps of the compressor 1 and a function l(Pd) of the discharge pressure Pd of the compressor 1. Therefore, the thrust force caused by the reaction force of gas can be calculated from the position L of the slide valve 8 and the suction pressure Ps and the discharge pressure Pd of the compressor 1, and thus the pressure setting value of the oil supply pressure Pb necessary to cancel the thrust force also can be determined easily. In addition, as is apparent from the above equation, the suction pressure detector 23 can be omitted in a case where the suction pressure Ps is constant, and the discharge pressure detector 24 can be omitted in a case where the discharge pressure Pd is constant. That is, the first embodiment explained earlier can be also thought to be the one in which the suction pressure detector 23 and the discharge pressure detector 24 of the present embodiment are omitted.

It should be noted that, in a so-called screw compressor unit as adopted in the compressor 1, the suction pressure Ps of the compressor 1 or the discharge pressure Pd of the compressor 1 is often controlled so as to be a constant value. In such cases, by detecting one of the suction pressure Ps of the compressor 1 or the discharge pressure Pd of the compressor 1, the thrust force caused by the reaction force of gas may be calculated from the detected value and the position L of the slide valve 8.

Figure 3:
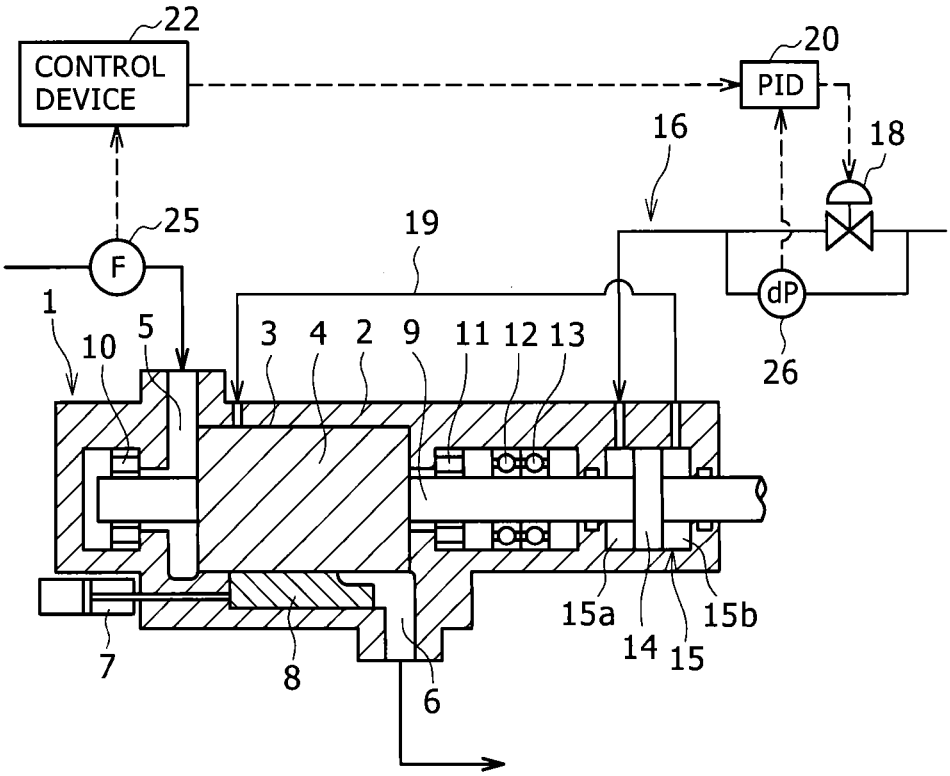
FIG. 3 is a schematic configuration diagram of a screw compressor unit according to a third embodiment of the present invention.

Further, FIG. 3 shows a configuration of a compressor unit according to a third embodiment of the present invention. The compressor unit of the present embodiment includes a suction flow rate detector 25 for detecting a flow rate of gas sucked by the compressor 1 and a valve differential pressure detector 26 for detecting a differential pressure of pressure oil before and behind the control valve 18.

In the present embodiment, pressure obtained by subtracting the differential pressure detected by the valve differential pressure detector 26 from the pressure of a supply source of pressure oil which is known beforehand is the pressure of oil supplied to the high-pressure chamber 15*a* of the balance cylinder 15. When the measuring range and the resolution of the equipment for detecting pressures are taken into account, in a case where the pressure of oil to be supplied to the high-pressure chamber 15*a* is large, an effective resolution within a range actually used may be enhanced if the pressure of the high-pressure chamber 15*a* is calculated from the differential pressure before and behind the control valve 18. Therefore, like the present embodiment, the opening of the control valve 18 could be adjusted such that the differential pressure before and behind the control valve 18 may become the setting value.

In addition, in the present embodiment, the capacity X of the compressor 1 is calculated from the detected value of the suction flow rate detector 25 (that is, the flow rate of gas sucked by the compressor 1), and then the pressure of oil to be supplied to the high-pressure chamber 15*a*, and thus the differential pressure before and behind the control valve 18 which is to be detected by the valve differential pressure detector 26 is determined. The capacity X of the compressor 1 can be also calculated as a value obtained by multiplying a difference of enthalpies of gas before and behind the compressor 1 by a mass flow rate of gas. Therefore, like the present embodiment, the setting value of the valve adjuster 20 may be determined based on the detected value of the suction flow rate detector 25. It should be noted that, in a case where the suction pressure or the discharge pressure is varied, as with the second embodiment, by adding the suction pressure detector 23 or the discharge pressure detector 24, the capacity X derived from the detected value of the suction flow rate detector 25 may be corrected.

Figure 4:
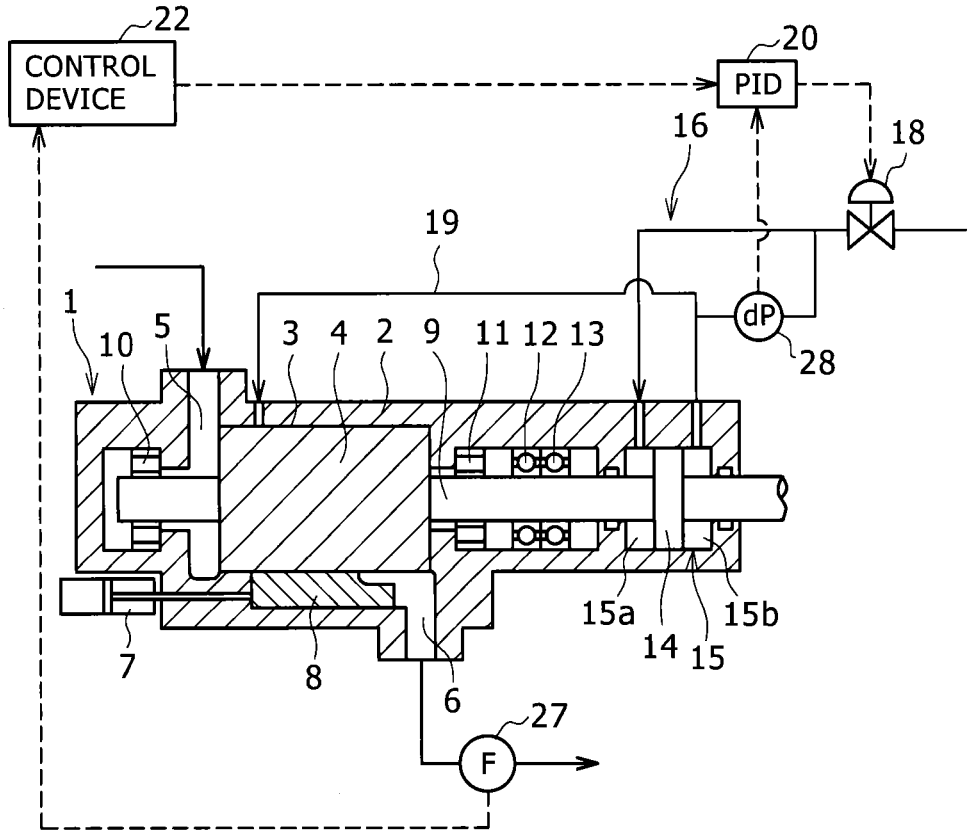
FIG. 4 is a schematic configuration diagram of a screw compressor unit according to a fourth embodiment of the present invention.

Further, FIG. 4 shows a configuration of a compressor unit according to a fourth embodiment of the present embodiment. The compressor unit of the present embodiment includes a discharge flow rate detector 27 for detecting a flow rate of gas discharged by the compressor 1 and a piston differential pressure detector 28 for detecting a differential pressure between pressure of a downstream side of the control valve 18 of the oil supply passage 16 and pressure of the low-pressure communicating passage 19.

As is apparent from the description of the third embodiment, the capacity X of the compressor 1 can be calculated from the flow rate discharged by the compressor 1 which is detected by the discharge flow rate detector 27 of the present embodiment as well. In addition, in the present embodiment, a differential pressure on either side of the balance piston 14 which is proportional to a pressing force of the balance piston 14 against the screw rotors 4 is directly detected by the piston differential pressure detector 28, thereby reducing calculation errors.

It should be noted that, in the respective embodiments mentioned above, when the flow rate of oil passing through the control valve 18 (that is, the flow rate of oil flowing out of the high-pressure chamber 15*a* to the low-pressure chamber 15*b* of the balance cylinder 15) is too small, it is difficult to adjust the pressure of the high-pressure chamber 15*a* by the opening of the control valve 18. Therefore, in order to secure the flow rate of oil passing through the control valve 18, a through-hole acting as a passage of oil may be provided in the balance piston 14, or a bypass passage connecting via an orifice or the like the oil supply passage 16 on the downstream side of the control valve 18 and the low-pressure communicating passage 19 may be provided.

In addition, the fluid applied to the balance piston 14 may be other fluids such as gas discharged by the compressor 1.

What is claimed is:

1. A compressor unit, comprising:

a casing;

a pair of male and female screw rotors contained in the casing and meshing with each other;

a compressor having the casing and the screw rotors and that compresses sucked gas and discharges it through a discharge passage;

a balance piston that presses a rotor shaft acting as a rotating shaft of at least one of the screw rotors in an axial direction by a fluid pressure;

a slide valve positioned in the casing between the pair of male and female screw rotors and the discharge passage so that a volume of compression space in communication with the discharge passage depends on a position of the slide valve, the slide valve driven by a fluid cylinder; and a balance piston control device, the balance piston control device including a positioner that detects a position of a piston of the fluid cylinder that drives the slide valve, a valve adjuster that adjusts an opening of a control valve based on a pressure setting value to thereby adjust pressure of a fluid applied on the balance piston to coincide with the pressure setting value, and a control device that sets the pressure setting value of the valve adjuster based on a detected value of the positioner.

2. The compressor unit according to claim 1, further comprising:

a suction pressure detector that detects pressure of gas sucked by the compressor, wherein the balance piston control device adjusts the pressure of the fluid applied on the balance piston by taking account of a detected value of the suction pressure detector.

3. The compressor unit according to claim 1, further comprising:

a discharge pressure detector that detects pressure of gas discharged by the compressor, wherein the balance piston control device adjusts the pressure of the fluid applied on the balance piston by taking account of a detected value of the discharge pressure detector.

4. The compressor unit according to claim 1, further comprising:

a suction pressure detector that detects pressure of gas sucked by the compressor, and a discharge pressure detector that detects pressure of gas discharged by the compressor, wherein the balance piston control device adjusts the pressure of the fluid applied on the balance piston by taking account of detected values of the suction pressure detector and the discharge pressure detector.

5. The compressor unit according to claim 1, wherein the valve adjuster comprises means for continuously varying the opening of the control valve.

6. The compressor unit according to claim 1, wherein the valve adjuster is a PID controller.

* * * * *